US008523561B2

(12) United States Patent
Huang et al.

(10) Patent No.: US 8,523,561 B2
(45) Date of Patent: Sep. 3, 2013

(54) COMBUSTOR OF WATER HEATER

(75) Inventors: Chung-Chin Huang, Taichung (TW); Chin-Ying Huang, Taichung (TW); Hsin-Ming Huang, Taichung (TW); Hsing-Hsiung Huang, Taichung (TW); Kuan-Chou Lin, Taichung (TW)

(73) Assignee: Grand Mate Co., Ltd., Taichung (TW)

( * ) Notice: Subject to any disclaimer, the term of this patent is extended or adjusted under 35 U.S.C. 154(b) by 535 days.

(21) Appl. No.: 12/797,578

(22) Filed: Jun. 9, 2010

(65) Prior Publication Data

US 2011/0306000 A1 Dec. 15, 2011

(51) Int. Cl.
*F23D 14/46* (2006.01)

(52) U.S. Cl.
USPC ..... 431/350; 431/354; 431/326; 126/116 R

(58) Field of Classification Search
USPC ..... 431/350, 354, 326, 181, 278, 285; 126/116 R, 112, 99 R, 91 A
See application file for complete search history.

(56) References Cited

U.S. PATENT DOCUMENTS 4,631,023 A * 12/1986 Courrege ..... 431/329

* cited by examiner

*Primary Examiner* — Alfred Basichas

(74) *Attorney, Agent, or Firm* — Tracy M. Heims; Apex Juris, pllc

(57) ABSTRACT

A combustor of a water heater includes a burner member and a flame cover. The burner member has a passageway therein with an inlet and an outlet. The flame cover has a plurality of flame holes. The character of the present invention is that the burner member is provided with a room at a top thereof communicated with the passageway. A separating device is put in the room, and the flame cover is connected to the burner member to cover the separating device The separating device has a main outlet and two side outlets right under the flame holes of the flame cover to generate main flames and side flames respectively.

6 Claims, 5 Drawing Sheets

COMBUSTOR OF WATER HEATER

BACKGROUND OF THE INVENTION

1. Field of the Invention

The present invention relates generally to a water heater, and more particularly to a combustor of a water heater.

2. Description of the Related Art

FIG. 1 shows a conventional combustor 50 of a water heater which includes a burner member 52 and a flame cover 54. The burner member 52 has two pressed plates connected together having a passageway 56 therein and a main outlet 58 at an end of the passageway 56. The main outlet is at a top of the burner member 52 and under the flame cover 54. A mixture of gas and air flows through the passageway 56 and flows out via the main outlet 58 for burning. The flame cover 54 is provided on the top of the burner member 52 having a plurality of flame holes.

For completing a full combustion, the burner member 52 is provided with side outlets 60 on a top sidewall of the passageway 56 that some mixed gas flows out via the side outlets 60. Burning of the mixed gas from the main outlet 58 generates main flames, and burning of the mixed gas from the side outlets 60 generates side flames. The side flames may separate burning and reduce burning temperature.

In the conventional combustor 50, there are gaps 66 between the burner member 52 and the flame cover 54 that air will come into the combustor 50 via the gaps 66 and cause too much air in the mixed gas, so the side flames usually get incomplete combustion. Besides, the edges of the side outlet 60 are easily broken or deformed during the pressing process when they are made.

SUMMARY OF THE INVENTION

The primary objective of the present invention is to provide a combustor of a water heater, which has no problem of leakage.

The secondary objective of the present invention is to provide a combustor of a water heater, which has no broken or deformed side outlet.

According to the objectives of the present invention, a combustor of a water heater includes a burner member having a passageway therein with an inlet and an outlet and a room at a top thereof. The room is open at a top of the burner member and the outlet is communicated with the room. A separating device is received in the room of the burner member having a main outlet and a side outlet. A flame cover has a plurality of flame holes connected to the burner member to cover the separating device. The main outlet and the side outlet of the separating device are under the flame holes of the flame cover.

DETAILED DESCRIPTION OF THE INVENTION

Figure 1:
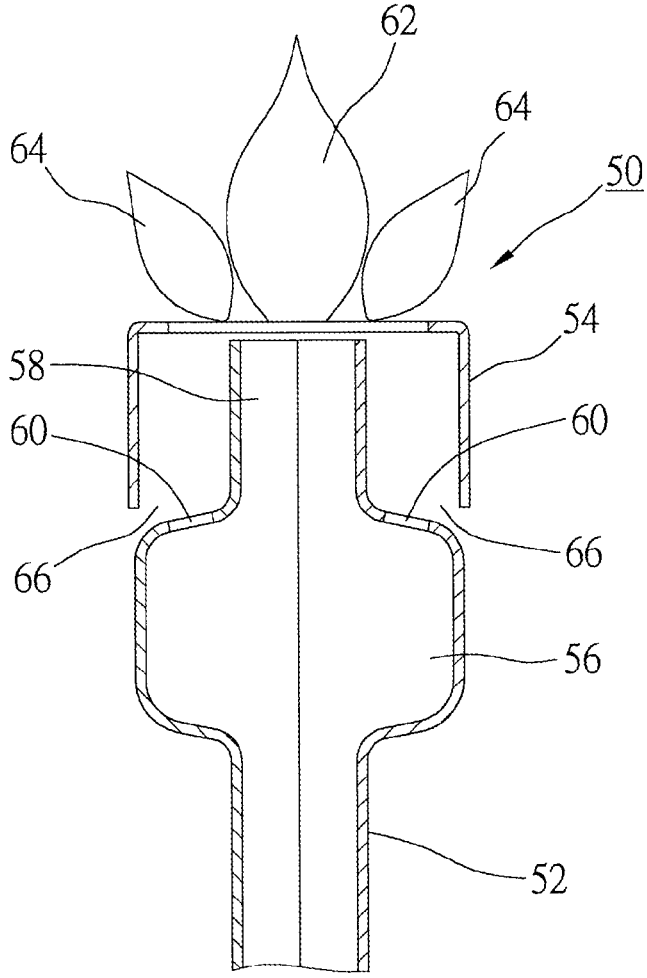
FIG. 1 is a sectional view of the conventional combustor.
Figure 2:
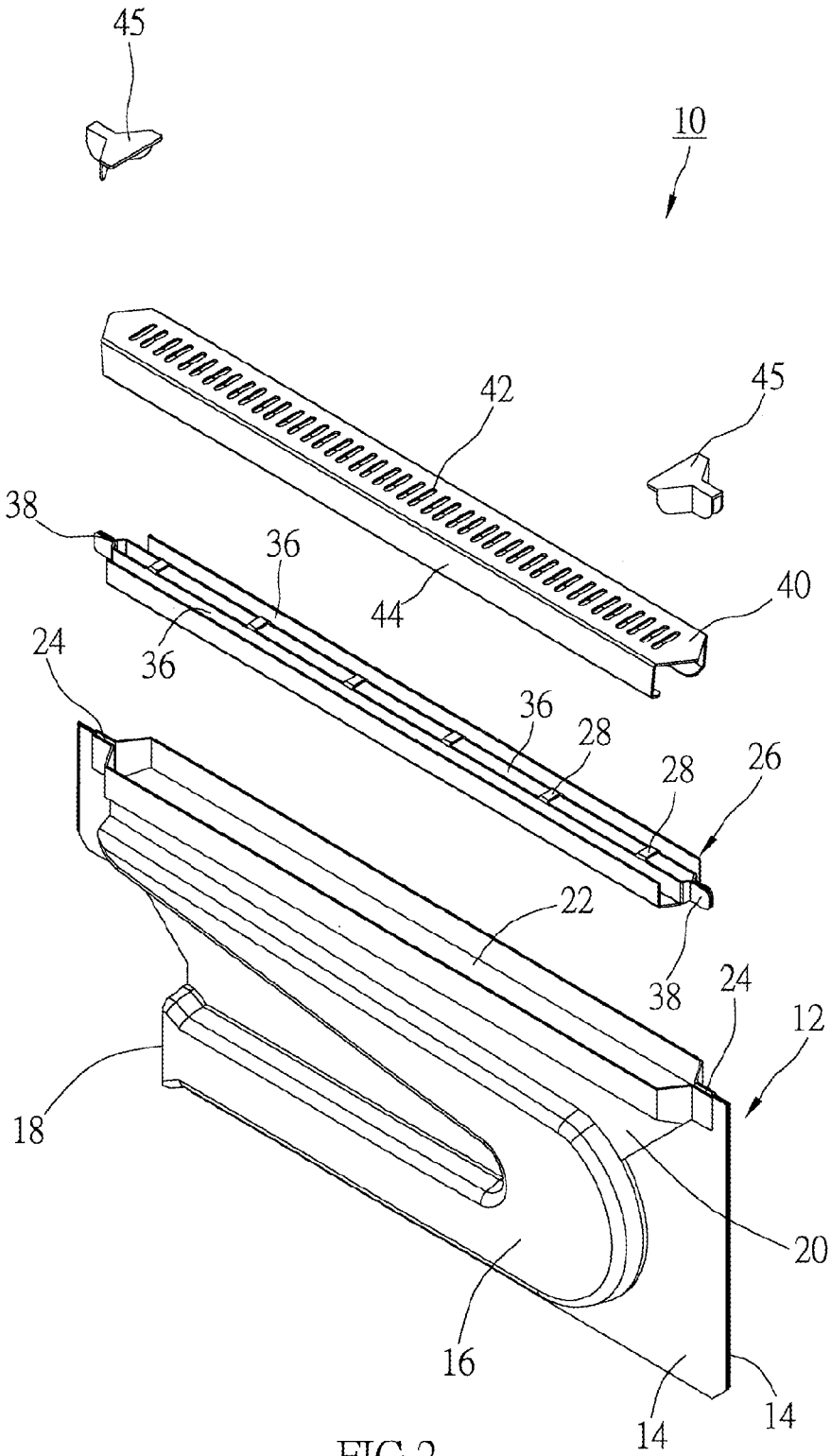
FIG. 2 is an exploded view of a preferred embodiment of the present invention in the closed condition.
Figure 3:
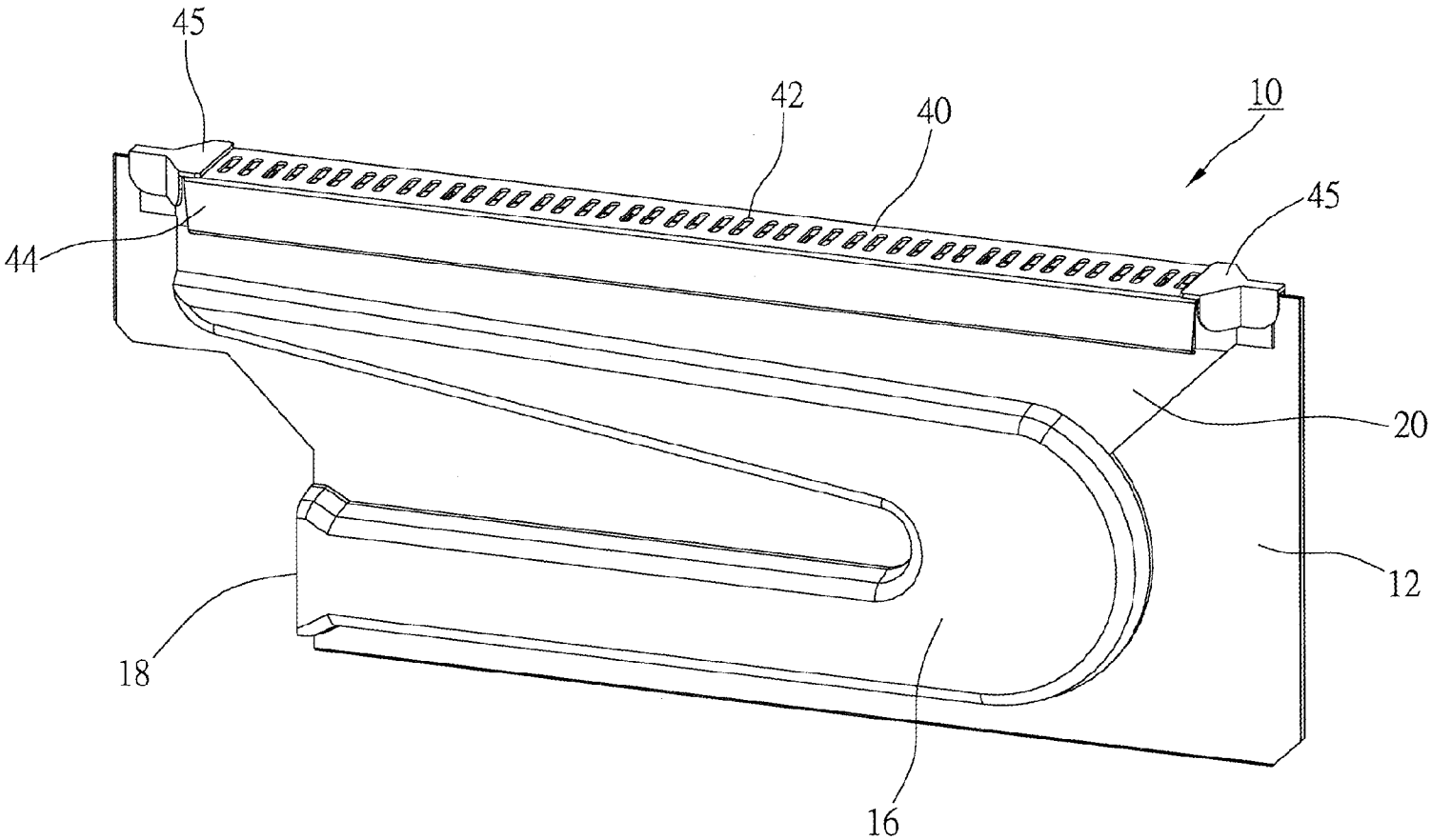
FIG. 3 is a perspective view of the preferred embodiment of the present invention in the closed condition.

As shown in FIG. 2 and FIG. 3, a combustor 10 of a water heater of the preferred embodiment of the present invention includes a burner member 12, a separating device 26 and a flame cover 40.

The burner member 12 has two pressed plates 14 connected together to form a U-shaped passageway 16 with an inlet 18 and an outlet 20. A gas supply (not shown), which supplies a mixture of gas and air, is connected to the inlet 18. The outlet 20 is at a top of the passageway 16. Between the plates 14 further has a room 22 above the outlet 20 of the passageway 16 and two slots 24 at opposite sides of the room 22. The room 22 is open at the top of the burner member 12, and the outlet 20 of the passageway 16 is at a bottom of the room 22.

Figure 4:
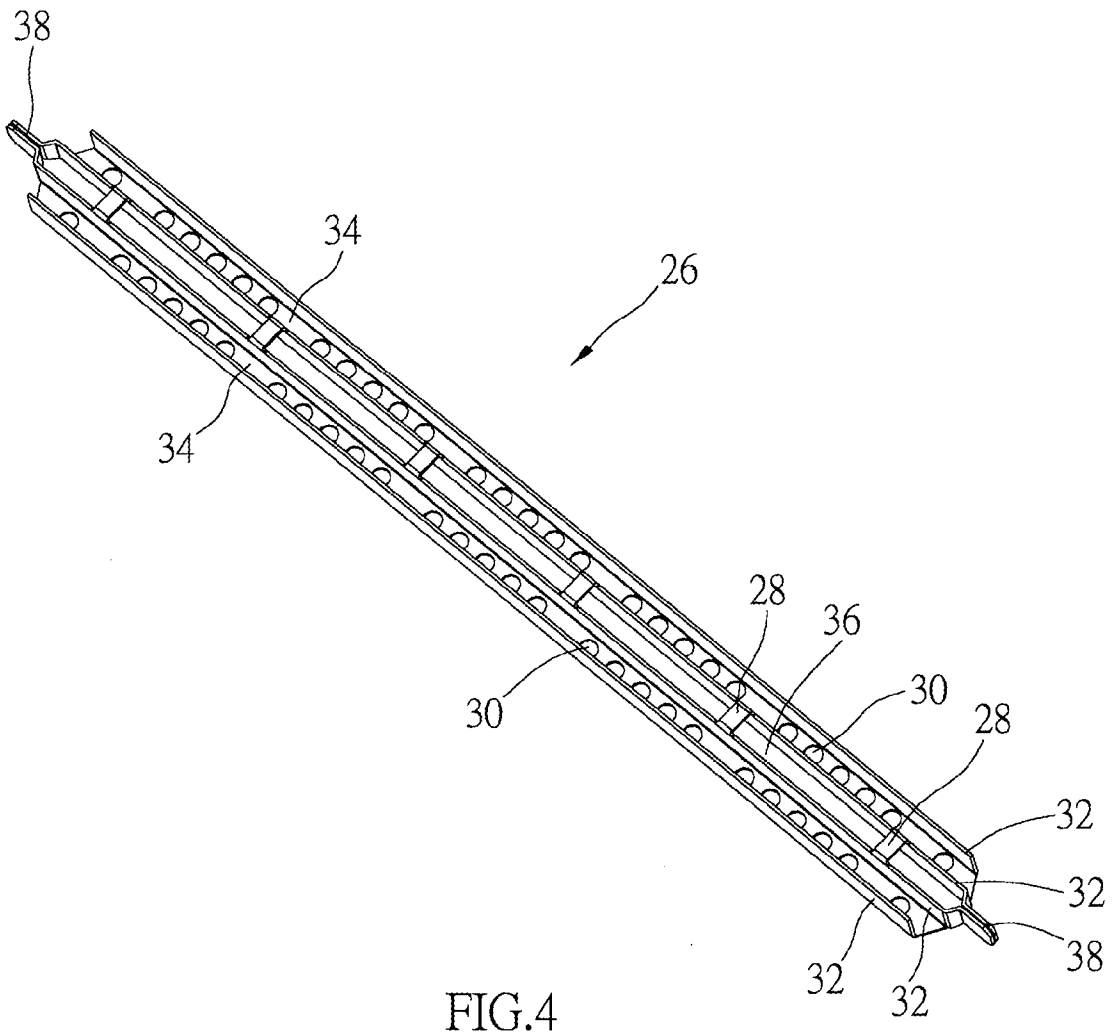
FIG. 4 is a perspective view the separating device of the preferred embodiment of the present invention in the opened condition.

As shown in FIG. 4, the separating device 26 has two U-shaped plates connected side-by-side by several pieces 28. Each U-shaped plate has several openings 30 in a line at a bottom thereof and two vertical sidewalls 32 at opposite of the openings 30. Between each pair of the sidewalls 32 is a side outlet 34, and between the U-shaped plates is a main outlet 36 with the pieces 28 crossing, i.e., the separating device 26 has two side outlets 34 and the main outlet 36 between the side outlets 34. The separating device 26 further has two plugs 38 at opposite ends, each of which is formed by protrusions extended from ends of the inner sidewall 32 connected together. The separating device 26 is put in the room 22 of the burner member 12 with the plugs 38 engaged with the slots 24.

The flame cover 40 has a similar structure to the conventional device, having a U-shaped plate with flame holes 42. The flame cover 40 has two sidewalls 44 with their distal ends bent inwards to match a shape of the room 22. The flame cover 40 is transversely fitted to the burner member 12 to cover the room 22 and the separating device 26, and two connectors 45 are engaged with the burner member 12 to fix the flame cover 40 to the burner member 12. The separating device 26 is right under the flame holes 42 of the flame cover 40.

Figure 5:
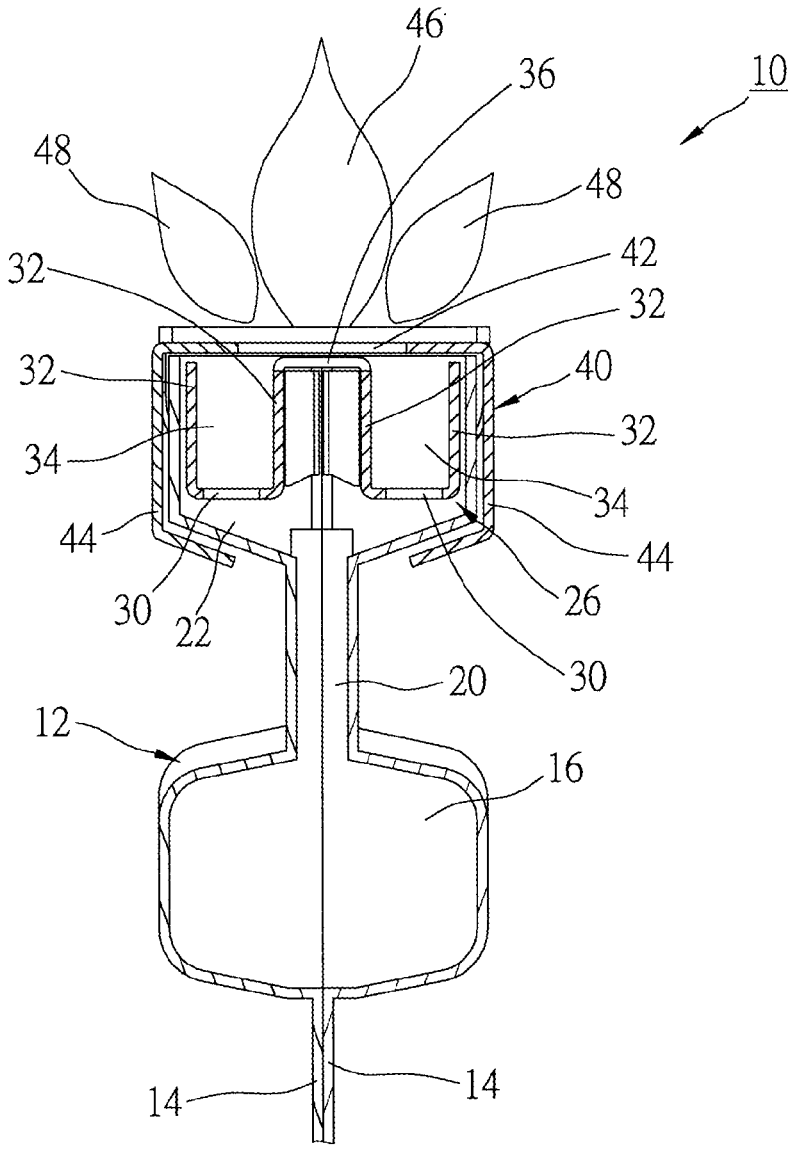
FIG. 5 is a sectional view of the preferred embodiment of the present invention in the opened condition.

As shown in FIG. 5, the mixed gas (not shown) enters the passageway 16 via the inlet 16 and flows into the room 22 through the outlet 20. Most of the mixed gas flows through the main outlet 36 of the separating device 26 for burning and generates main flames 46, and some of mixed gas flows through the openings 30 and the side outlets 34 for burning and generates side flames 48.

The advantages of the present invention are:

1. The separating device is installed in the room of the burner member and the flame cover totally covers the separating device and the room to prevent the leakage. Besides, the sidewalls of the separating device also help to prevent leakage.

2. The separating device is an independent element which will reduce the possibility of opening being deformed or broken.

3. With a specific design of the separating device, it may easily adjust amounts of the mixed gas flowing through the main outlet and the side outlets at a referred ratio.

The description above is a few preferred embodiments of the present invention and the equivalence of the present invention is still in the scope of claim construction of the present invention.

What is claimed is:

1. A combustor of a water heater, comprising:

a burner member having a passageway therein with an inlet and an outlet and a room at a top thereof, wherein the room is open at a top of the burner member and the outlet is communicated with the room;

a separating device, which is received in the room of the burner member, having a main outlet and a side outlet and wherein the separating device has two U-shaped plates, between the U-shaped plates is the main outlet, and each of the U-shaped plates has openings at a bottom thereof to form the side outlet and where an orientation of the side outlet and the main outlet are parallel and toward the same direction; and a flame cover, which has a plurality of flame holes, connected to the burner member to cover the separating device, wherein the main outlet and the side outlet of the separating device are under the flame holes of the flame cover.

2. The combustor of the water heater as defined in claim 1, wherein the separating device has two sidewalls, between which is the main outlet, and two sidewalls, between which is the side outlet.

3. The combustor of the water heater as defined in claim 1, wherein the U-shaped plates are connected by pieces, which cross the main outlet.

4. The combustor of the water heater as defined in claim 1, wherein the separating device has two plugs at opposite sides to be engaged with slots of the burner member at opposite sides of the room.

5. The combustor of the water heater as defined in claim 1, wherein the flame cover has two sidewalls to cover the room of the burner member.

6. The combustor of the water heater as defined in claim 5, wherein distal ends of the sidewalls of the flame cover are bent inwards to match a shape of the room.

* * * * *